United States Patent [19]

Minter

[11] Patent Number: 5,007,215

[45] Date of Patent: Apr. 16, 1991

[54] SUNROOM

[75] Inventor: Mearl Minter, Oskaloosa, Iowa

[73] Assignee: Rolscreen Company, Pella, Iowa

[21] Appl. No.: 342,094

[22] Filed: Apr. 24, 1989

[51] Int. Cl.[5] ..... E04B 7/02; E04C 3/18; E04D 1/36

[52] U.S. Cl. ..... 52/90; 52/58; 52/463; 52/467; 52/468

[58] Field of Search ..... 52/58, 79.6, 86, 464, 52/467, 468, 463, 460, 470, 471, 74, 82, 90, 93; 47/17

[56] References Cited

U.S. PATENT DOCUMENTS

| | | | |
|---|---|---|---|
| 697,220 | 4/1902 | Staples | 52/90 |
| 2,166,108 | 7/1939 | Jensen | 20/40.5 |
| 3,314,203 | 4/1967 | Hill et al. | 52/470 |
| 4,228,791 | 10/1980 | Hirai et al. | 52/460 |
| 4,418,506 | 12/1983 | Weber et al. | 52/209 |
| 4,462,390 | 7/1984 | Holdridge et al. | 126/430 |
| 4,471,584 | 9/1984 | Dietrich | 52/14 |
| 4,583,333 | 4/1986 | Minter | 52/90 |
| 4,680,905 | 7/1987 | Rockar | 52/200 |

*Primary Examiner*—Michael Safavi

*Attorney, Agent, or Firm*—Zarley, McKee, Thomte, Voorhees & Sease

[57] ABSTRACT

Adhesive foam seals are provided on all flashing components of a sunroom at joints between glazing panels and other structural members. Should water or wind penetrate these seals, primary and secondary drain systems are provided as a backup to collect and control and vent moisture outside the sunroom. A support frame for the glazing panels includes sloped vertical wooden beams strengthened by top and bottom steel plates. The beams are covered with a plastic moisture-proof coating. An adjustable corner flashing is used which compensates for any minor misalignment of front and end walls.

19 Claims, 7 Drawing Sheets

SUNROOM

BACKGROUND OF THE INVENTION

The typical sunroom having glazing panels interconnected to each other and the outside wall of a building may at times experience the problem of water leakage due to joint calking failure. What is needed is a sunroom system utilizing the best possible primary seal at each of the joints but also having a backup drainage system that will vent to the outside any water that has penetrated the seals.

The sunroom should be simple to construct by having joints which are forgiving to minor misassembly errors.

SUMMARY OF THE INVENTION

A support frame grid of vertically orientated wooden beams is first constructed and then glazing panels are placed on top of these beams to complete the sunroom. Each of the beams includes a channel on the top side which receives leakage water from the glazing panels. The water is vented to the outside from the beam channels. The beam channel includes a moisture proof plastic coating to protect the wood from moisture.

Each of the glazing panels includes a perimeter frame having a pair of upwardly facing channels and also a pair of downwardly facing channels.

The horizontal or laterally extending edges (perimeter frame) of the glazing panels function as backup drains for any moisture getting past the moisture seals. The perimeter frame channels also function as mechanical means for interconnecting the glazing panels and securing them to the beam support frame.

A backup secondary drain system is provided at each of the joints which includes a gutter secured to the bottom side of the panels by an upwardly extending rib being received in a channel in the perimeter frame. These gutters empty water in either direction to the channels in the beams. The drainage systems are provided at the roof connection to the building wall, connections between adjacent panels and along the lower edge of the bottom panels.

The wooden beams are strengthened by a metal plate being placed on the bottom side running lengthwise of the beam and a pair of plates being placed on the top side. A rib of wood extends between the top plates and receives screws for holding the glazing panels to the beam and covering the beam joint to the glazing panels through the use of a mullion cover.

An adjustable corner flashing is provided that allows for misalignment in the front and end walls by the corner flashing having elongated grooves which receive the edges of plates on the walls.

DESCRIPTION OF THE PREFERRED EMBODIMENT

Figure 1:
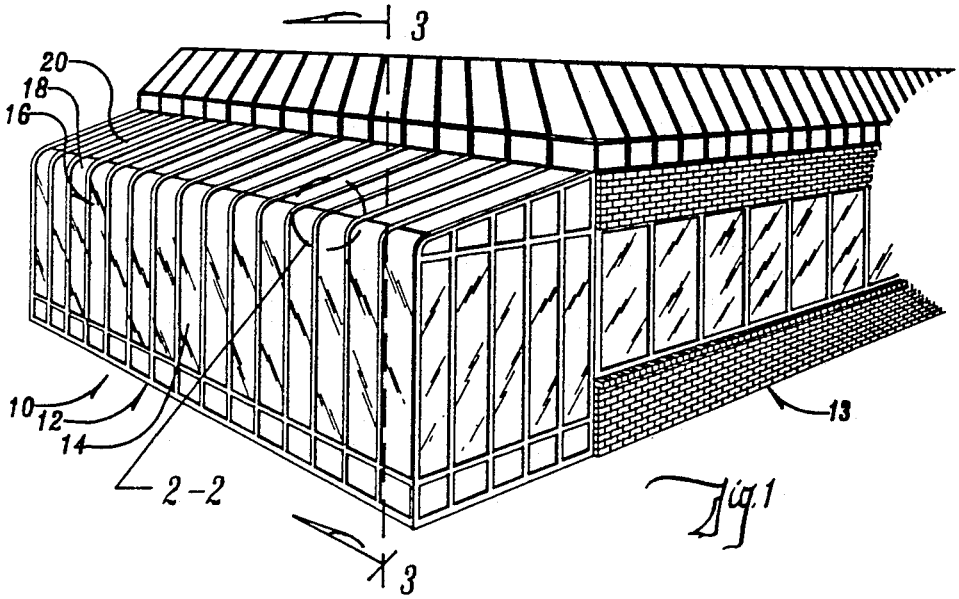
FIG. 1 is a perspective view of a building having a curved roof sunroom.

The sunroom of this invention is referred to generally by the reference numeral 10 in FIG. 1 and is shown on the side of a building 12. The sunroom 10 includes a sloped roof 13 having a front wall having panels 16 with curved upper ends 18 which are joined to the lower ends of roof panels 20.

A frame structure is provided comprised of sloping vertical beams 22 which interconnect with vertical front wall beams 23. The beam 22 is of laminated wood and includes an upwardly facing channel 24 on its top side. The channel has side walls 26 and a base 28. The base 28 includes an upstanding center ridge 30 of wood which spaces apart a pair of steel plates 32 which strengthens the beams and balances it against the strengthening plate 34 on the bottom side held by screws 37. The channel 24 is covered by a sheet of plastic such as the Ice and Water Shield ® 35 supplied by the W. R. Grace and Co. This keeps all moisture from penetrating the wood beam.

Figure 5:
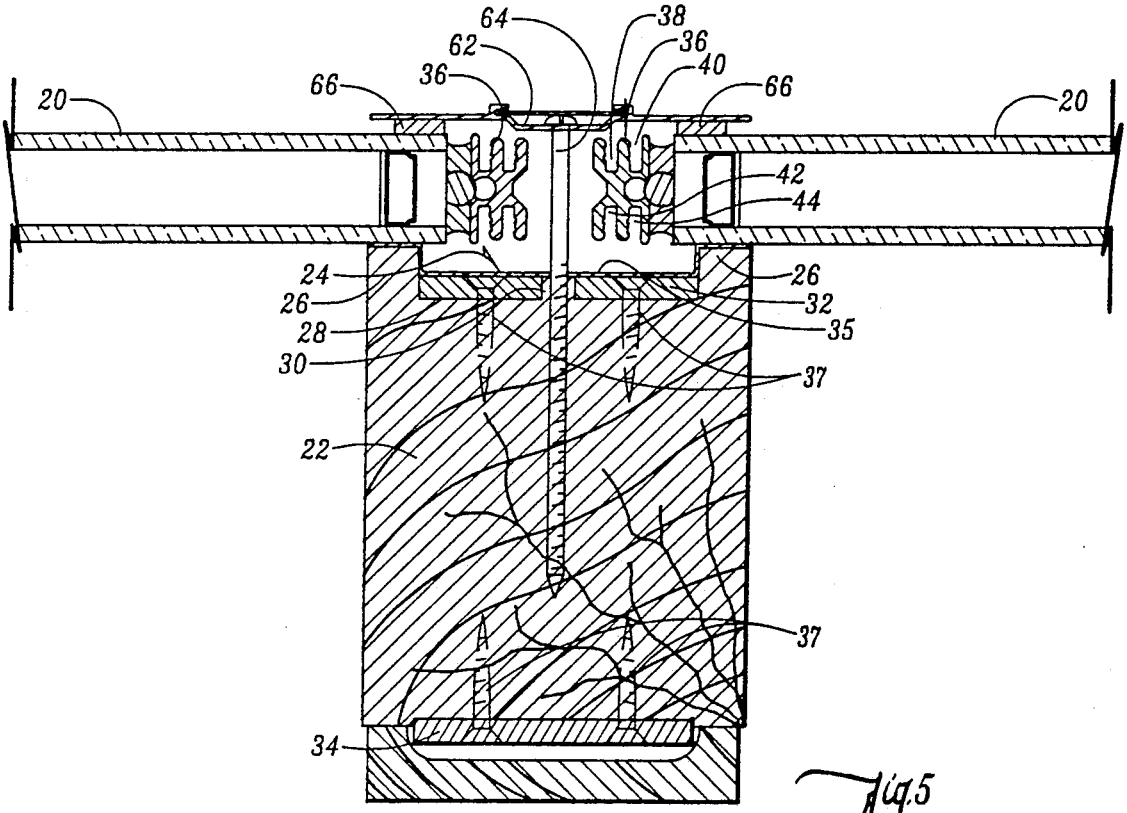
FIG. 5 is a cross-sectional view taken along line 5—5 in FIG. 2.

The glazing panels 20 include a metal perimeter frame 36 which includes, as seen in FIG. 5, upwardly facing channels 38 and 40 and downwardly facing channels 42 and 44.

Figure 2:
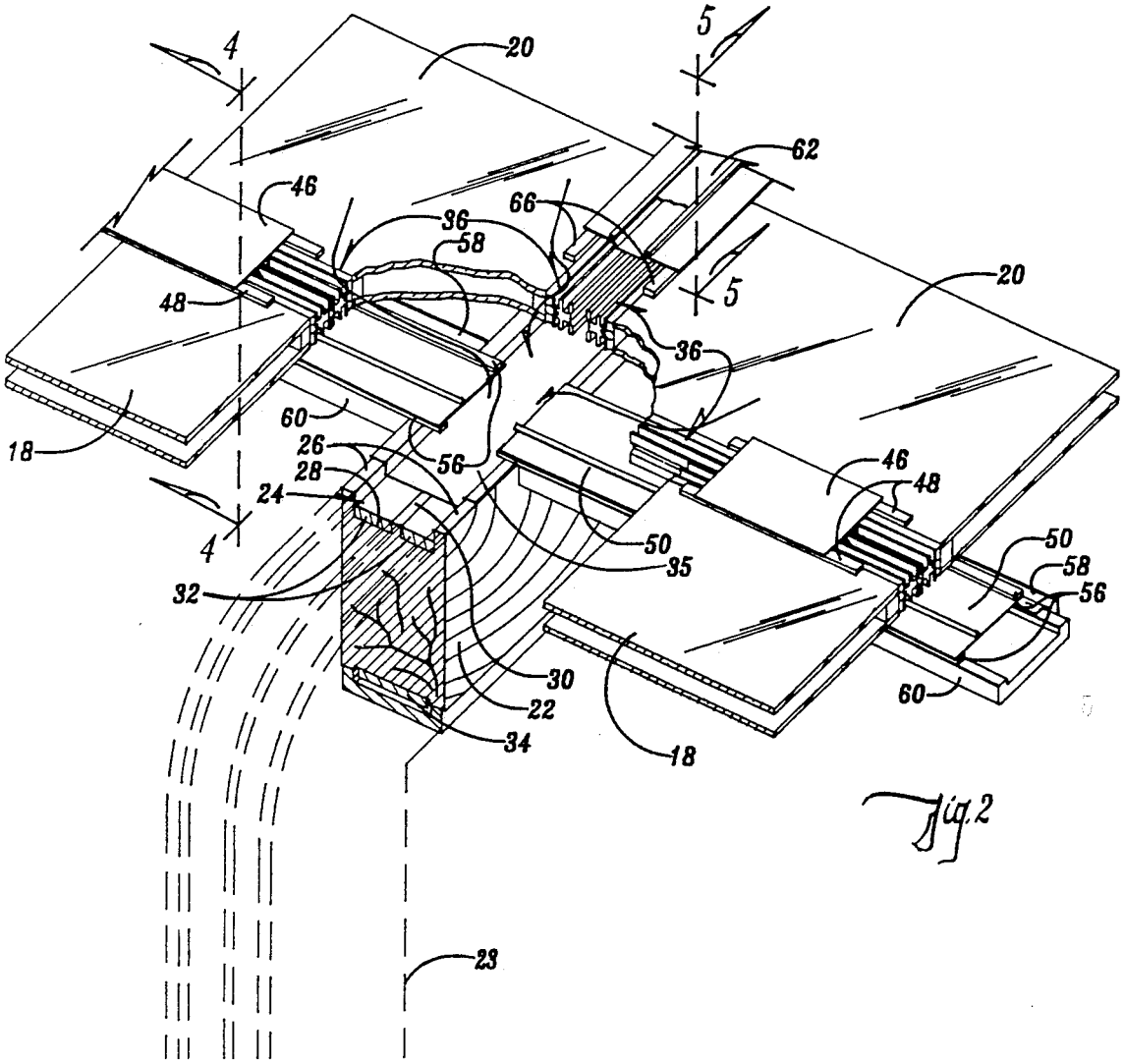
FIG. 2 is an enlarged perspective view of a portion of the roof and front wall as indicated by the line 2—2 in FIG. 1.

As seen in FIG. 2 a mullion cover 46 having foam material 48 on either side is held by adhesive to the top glass surfaces of the panels 18 and 20. Any water that should penetrate past the foam seals 48 adhesively held in place should be received in the channels 38 and 40. This water would be routed to the beam channel 24 on either side of the glazing panels 20.

Figure 4:
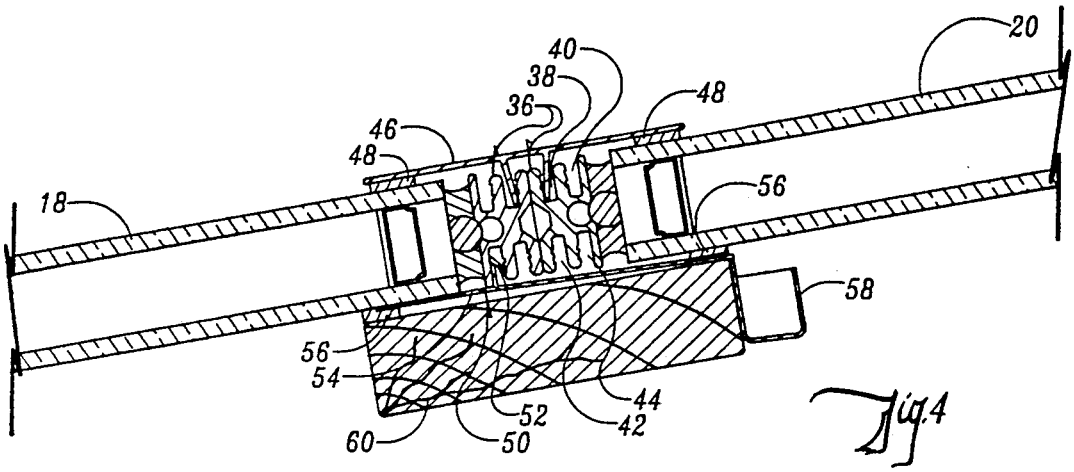
FIG. 4 is a cross-sectional view taken along line 4—4 in FIG. 2.

Should wind enter the joint of FIG. 4 or the water exceed the capacity of the perimeter frame channels 38 and 40, a backup drain is provided under the panels 18 and 20. The backup drain includes a gutter flashing 50 which has an upstanding rib 52 received in the frame channel 44. A flange 54 extends upwardly under the end to end perimeter frames and has a foam seal 56 engaging the bottom glass in the glazing panel 20.

A condensation gutter 58 is provided on the lower end of the glazing panel 20 to receive moisture on the bottom side of the glazing panel 20 occurring through condensation. This water will be allowed to evaporate in the gutter 58. This gutter extends between each of the beams 22 and is appropriately fastened to the wood cross member 60. It is thus seen that the moisture reaching the gutter 50 will be channeled to the oppositely disposed beams 22.

The glazing panels 20 are supported along their side edges on the upstanding walls 26 forming the sides of the drain channel 24 by the glass of the panels resting directly on the walls 26. Thus the metal perimeter frame 36 is disposed over the beam channel 24 in spaced relation to the adjacent frame 36. A mullion cover 62 is provided over the perimeter frames 36 and a screw 64 locks the cover to the glazing panel edges and to the beam 22. The screw 64 is anchored in the wood ridge 30 between the reinforcing plates 32. Foam seals 66 are provided between the mullion plate 62 and the glass in the panels 20.

Figures 3, 7:
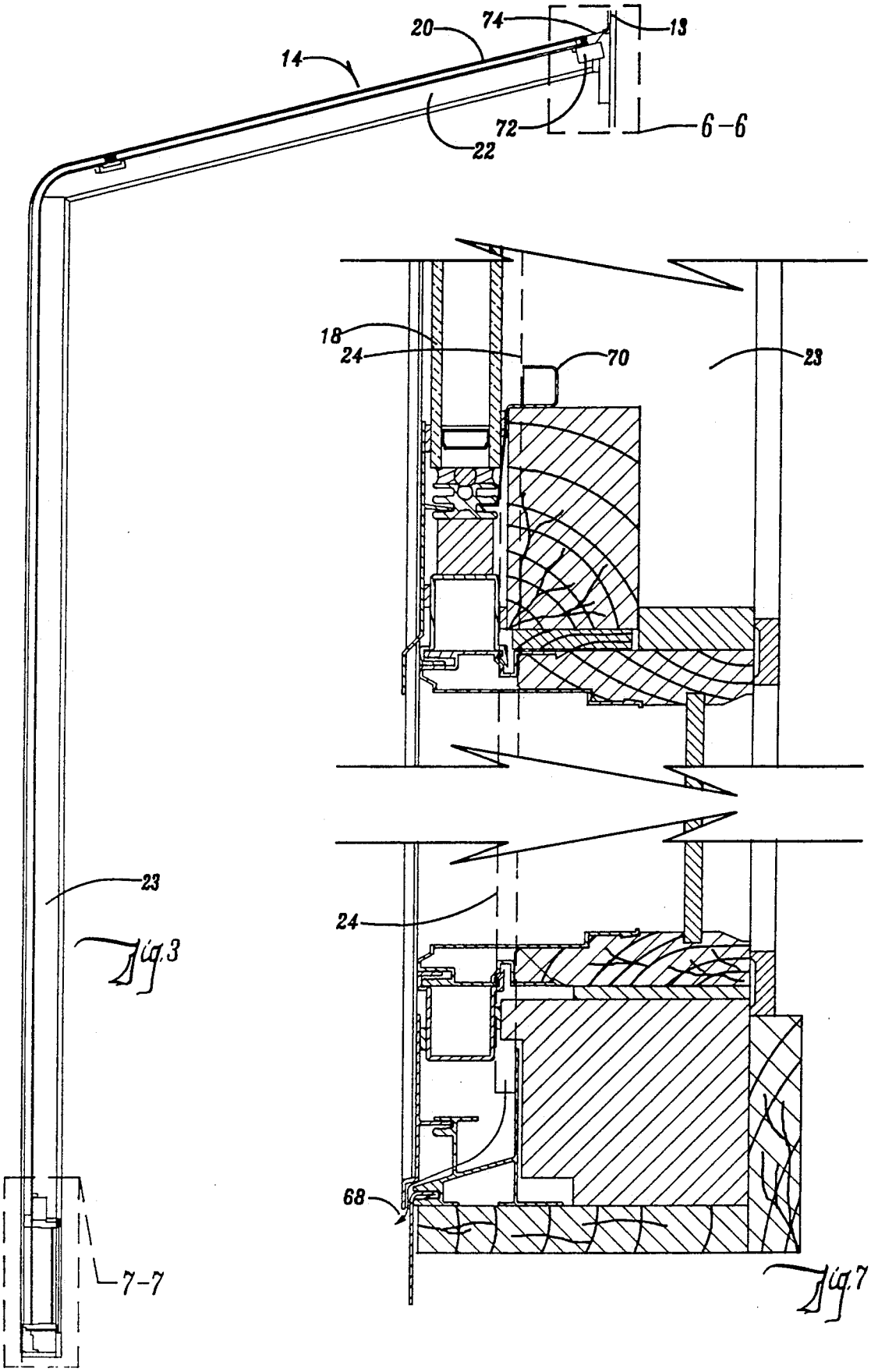
FIG. 3 is a cross-sectional view taken along line 3—3 in FIG. 1.
FIG. 7 is an enlarged cross-sectional view of the lower end of the front wall area indicated by the line 7—7 in FIG. 3.

Moisture received in the beam channel 24 continues on down the channel in the vertical beam 23 as seen in FIG. 2 and is vented away at 68 as seen in FIG. 7. As also seen in FIG. 7, a condensation gutter 70 is provided that the lower end of the vertical front wall glazing panels 16.

Figure 6:
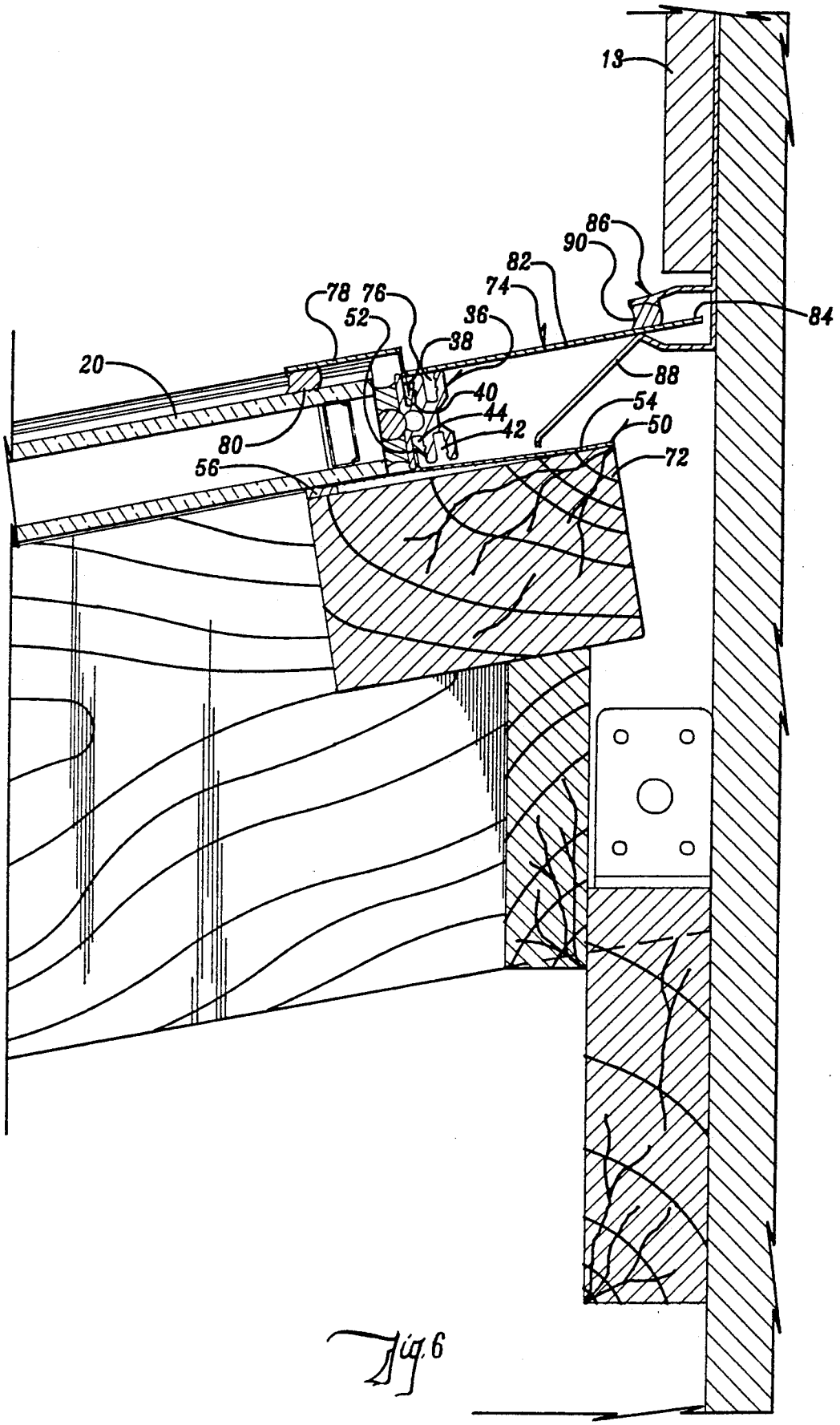
FIG. 6 is an enlarged cross-sectional view of the roof and building wall connection indicated by the line 6—6 in FIG. 3.

In FIG. 6 it is seen how the glazing panels 20 meet the building 13. The upper edges of the panels are supported on a cross beam 72 supported on the building 13. A flashing 74 includes a downwardly extending rib 76 received in the perimeter frame channel 40. The flashing includes an L-shaped portion 78 which extends upwardly and then along the panel downwardly from the rib 76 and includes foam 80 which sealingly engages the glass in the glazing panel 20. A forwardly extending flange 82 extends toward the building 13 and has a free end 84 received in a receptor 86 which includes a downwardly and forwardly extending flange 88. Silicone grouting 90 seals the free end 84 of the flange 82 in the receptor 86.

Figure 12:
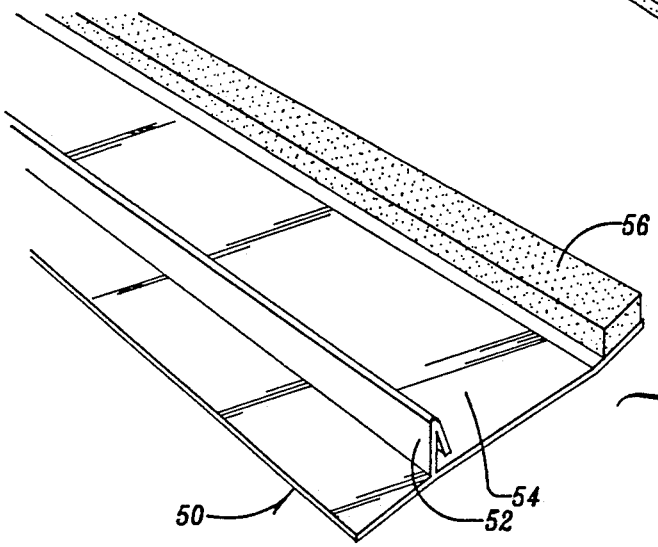
FIG. 12 is a fragmentary perspective view of the secondary drain gutter beneath interconnected glazing panels and between the roof and the building wall.
Figure 13:
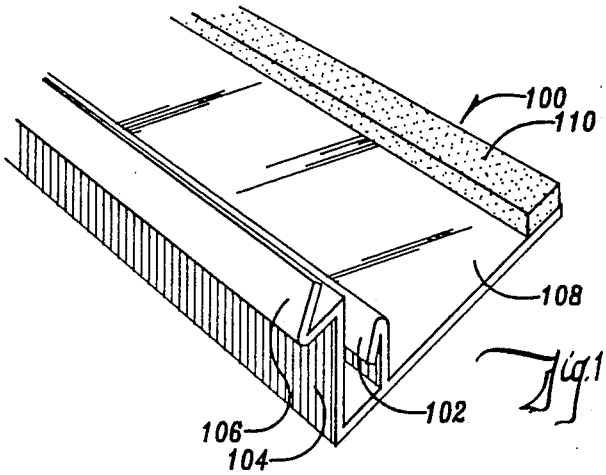
FIG. 13 is a fragmentary perspective view of the horizontal gutter flashing along the bottom edge of the glazing panels.

The gutter flashing 50 of FIG. 12 is positioned below the perimeter frame with the rib 52 extending upwardly into the channel 44 while the flange 54 extends upwardly towards the building 13 and under the free end of the downwardly extending flange 88 on the receptor 86. Thus it is seen that any moisture that should get into the space below the flashing 74 should be channeled either to the left or the right and into the adjacent beam channel 24.

Figure 8:
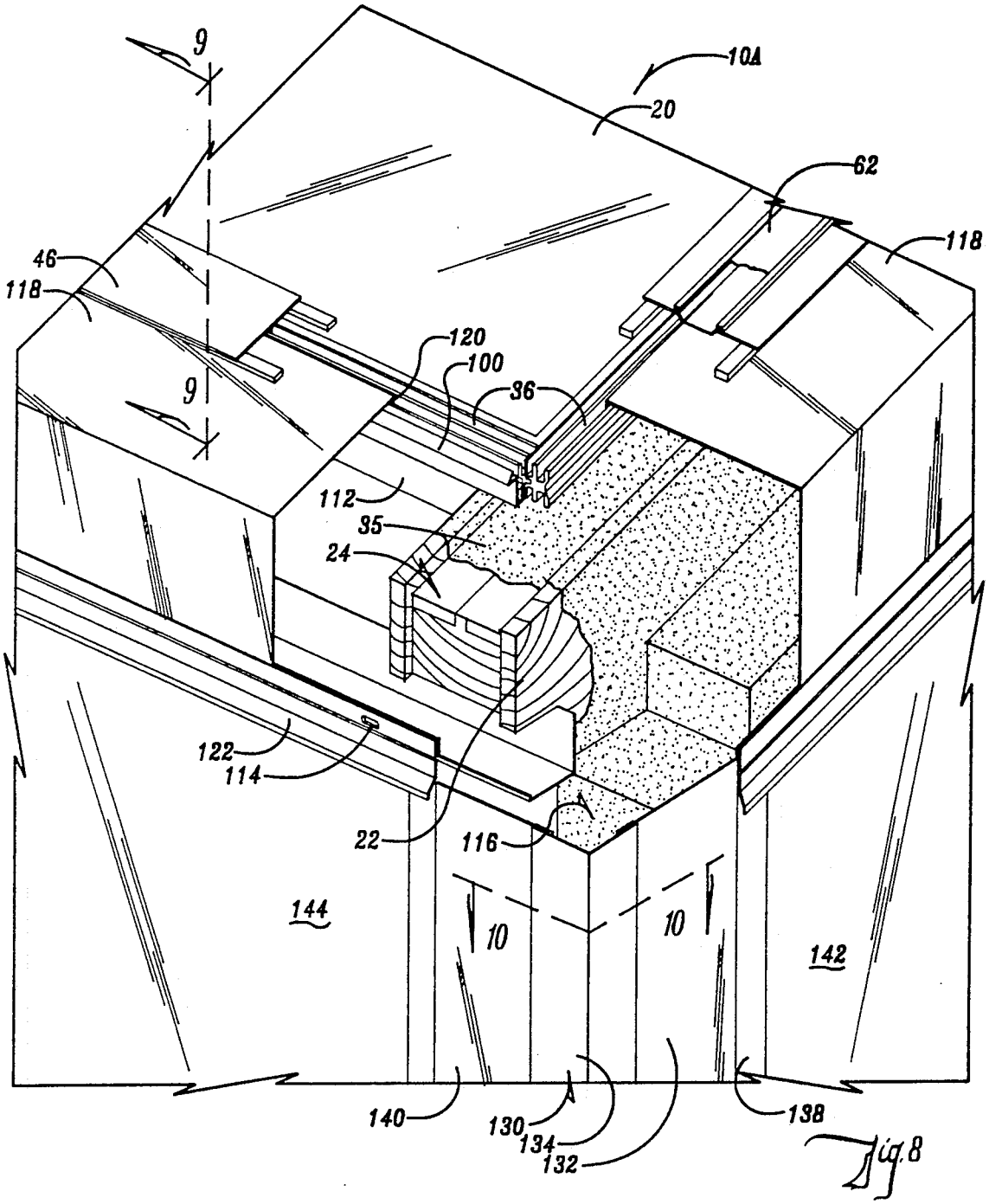
FIG. 8 is a fragmentary perspective view of a straight wall sunroom.
Figure 9:
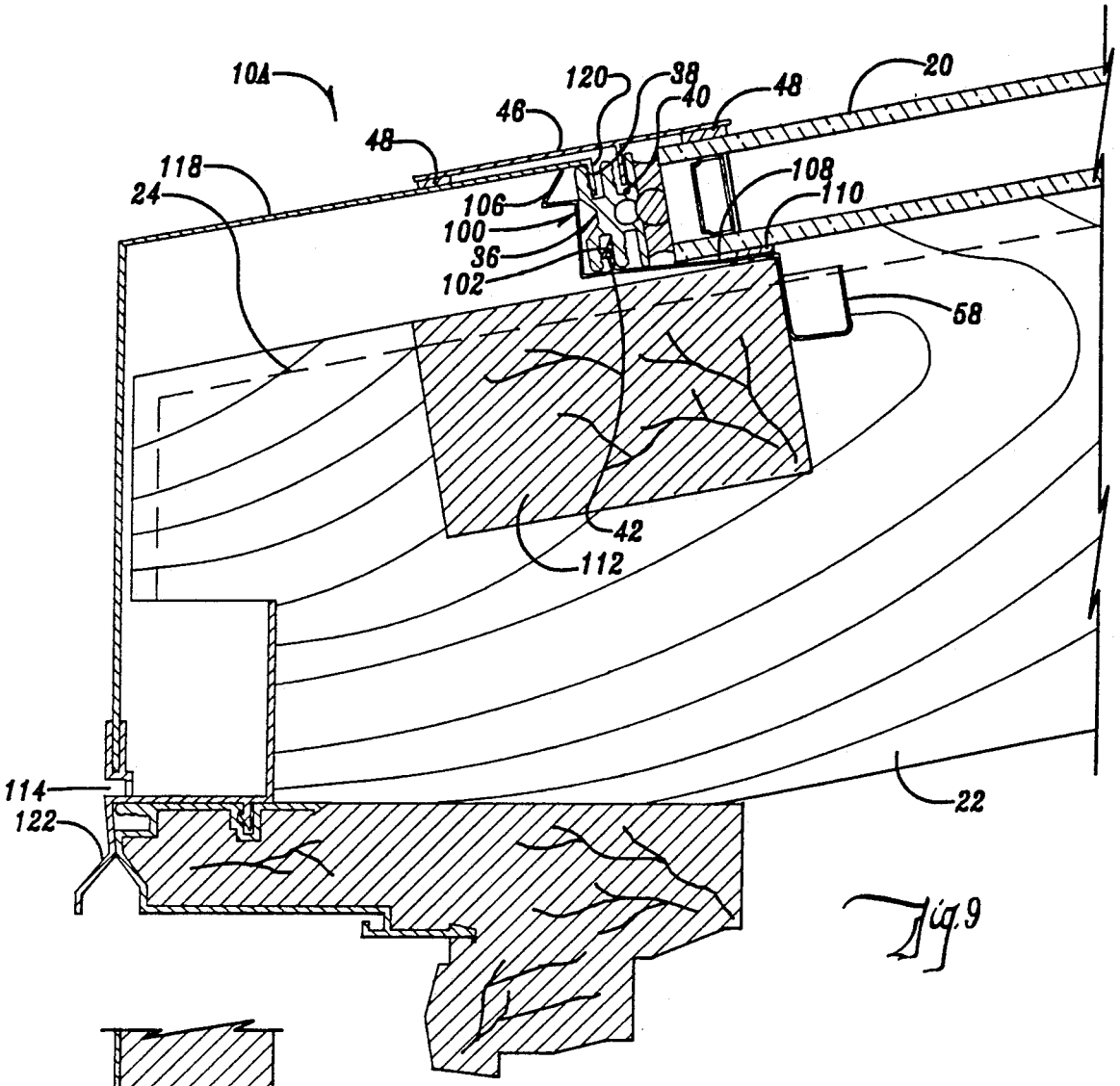
FIG. 9 is a cross-sectional view taken along line 9—9 in FIG. 8.
Figure 10:
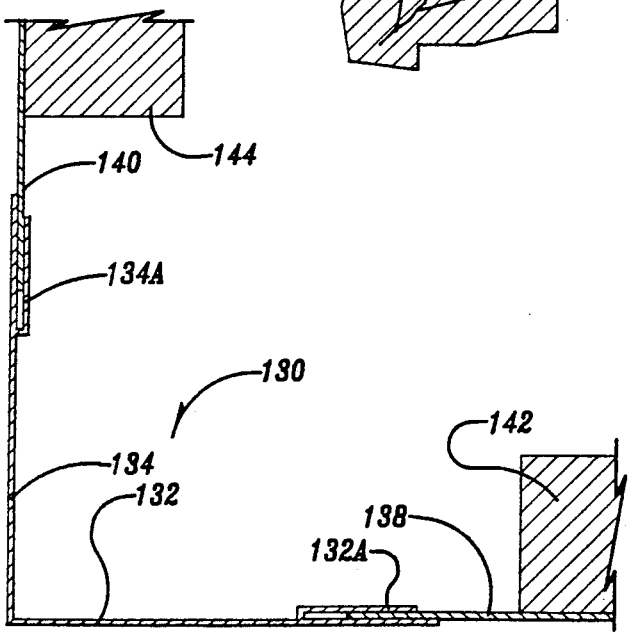
FIG. 10 is a cross-sectional view taken along line 10—10 in FIG. 8 showing the adjustable corner flashing.
Figure 11:
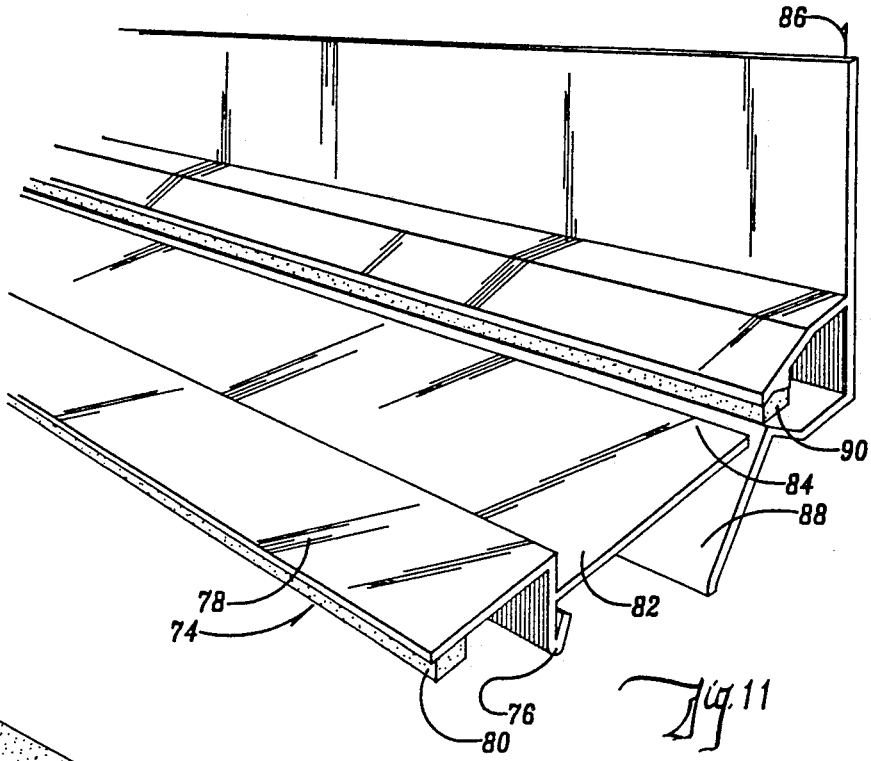
FIG. 11 is a fragmentary perspective view of the flashing and flashing receptor at the top of the roof and building wall.

A straight wall sunroom 10A is shown in FIGS. 8–10. These figures illustrate several features which are different from the curved wall sunroom 10 of FIGS. 1–7. The lower edge of the glazing panel 20 includes a gutter flashing 100 which has an upstanding rib 102 received in the channel 44 of the perimeter frame 36. A flange 104 extends from the rib 102 downwardly along the panel and then upwardly where it terminates in a gutter 106 which extends laterally between the adjacent beam channels 24 whereby any moisture blown past the mullion cover 46 having the foam seals 48 will be collected and routed away from the interior of the sunroom and away from the wood members of the sunroom. A forwardly extending flange 108 extends from the rib 102 and has foam 110 on its forward free end which engages the glass in the glazing 20. A condensation gutter 58 is provided on the forward side of the cross beam 112.

Moisture in the channel 24 is vented outside the sunroom through weep hole 114 as seen in FIG. 8. It may also go to the end of the sunroom and down the corner passageway 116 where it is vented outside at the ground.

A cover flashing 118 finishes off the corner of the sunroom roof connection to the front vertical wall glazing panels. It includes a downwardly extending leg 120 received in the channel 40 of the perimeter frame 36 while a lower leg is received in a receptor 122 as seen in FIG. 9. The unexposed side of the beam 22 is covered with the plastic coating as seen in FIG. 8.

To accommodate possible misalignment of the front and end walls an adjustable corner flashing 130 is provided. The corner flashing 130 has legs 132 and 134 with vertical grooves which receive wall plates 138 and 140, respectively, connected to the end walls 142 and 144, respectively. It is thus seen that the elongated grooves 132A and 134A and allow for a wide range of adjustment to compensate for any minor misalignment errors made during construction.

I claim:

1. A sunroom comprising, a frame support structure including a roof having support beams, said beams being elevated at one end and extending downwardly at the other end, each of said beams having top and bottom sides and being constructed of wood and including a channel shaped top side extending longitudinally of said beam for receiving water, and a pair of spaced apart metal reinforcement plates extending the substantial length and longitudinally of said beams in the bottom of said channel and fixedly secured to said beam whereby water received in said channel is adapted to run operatively over said plates to the other end of said beam.

2. The structure of claim 1 wherein a longitudinally extending reinforcing plate is fixedly secured to and is in substantial contact with the bottom side of said beam to balance the beam relative to the plates on the top side.

3. The structure of claim 1 wherein a longitudinally extending upstanding ridge of wood extends between said pair of plates in said channel and receives a wood screw for securing a mullion cover to said beam for holding adjacent ends of glazing panels in place above said channel.

4. The structure of claim 1 wherein said top side of said beam is covered with a water resistant coating for protecting said wood beam from moisture and to provide a drain channel for moisture in said channel.

5. A sunroom comprising, a frame support structure including a roof having support beams, said beams being elevated at one end and extending downwardly at the other end, each of said beams having top and bottom sides and including a channel shaped top side extending longitudinally of said beam for receiving water, said roof including glazing panels having adjacent side edges supported on the top side of said beam and overlaying said channel, and said glazing panels including horizontal laterally extending drainage means positioned to empty into said beam channel for delivery of water to the other end of said beam.

6. The structure of claim 5 wherein said support beam is made of wood and said top side of said beam is covered with a water resistant coating for protecting said wood beam from moisture.

7. The structure of claim 5 and a mullion cover is provided on top of the edges of the glazing panels and screw means extends from said cover between said panel edges into anchoring engagement with said beam to lock said panels to said beam.

8. The structure of claim 5 wherein said drainage means has a primary drain which includes a glazing horizontal perimeter frame including an upwardly facing channel extending along one horizontal edge of said glazing panel laterally to said beam for draining water into said beam channel.

9. The structure of claim 8 and said glazing panels are further defined as being disposed end to end vertically in said roof with the perimeter frame channel of each glazing panel being in side by side relationship, and a mullion cover interconnects said perimeter frame channels.

10. The structure of claim 9 wherein a primary seal is provided between each of said glazing panels and said mullion cover.

11. The structure of claim 10 wherein a secondary drain is provided between and under each of said horizontal perimeter frames, and said horizontal perimeter frame includes a downwardly facing channel on its bottom side, and a flashing gutter is positioned below the perimeter frame of said side by side glazing panels.

12. The structure of claim 11 wherein said flashing gutter includes an upstanding rib received in one of said side by side downwardly facing horizontal perimeter frame channels and a flange extends upwardly in a plane parallel to said panels thereby forming a water escape passageway, and said flashing gutter extends to said beam whereby said water in said passageway is emptied into said beam channel.

13. The structure of claim 12 wherein said flange is positioned closely adjacent the bottom sides of said side by side panel perimeter frames.

14. The structure of claim 13 wherein said frame support structure is further defined by said beams being spaced apart and each of said panels having vertical perimeter frames being supported by said spaced apart beams engaging the glazing adjacent the vertical perimeter frames whereby water in said primary and secondary drains may drain into each of said spaced apart beam channels.

15. The structure of claim 8 wherein said drainage means includes a secondary drain positioned below said horizontal perimeter frame, said glazing panels having top and bottom ends, said primary and secondary drains being at the bottom ends of said panels, said perimeter frame at the bottom end of said glazing panel including a downwardly facing channel on its bottom side, and a flashing gutter including a mounting means is positioned therebelow, said flashing gutter mounting means including an upstanding rib received in said downwardly facing channel and a flange extends downwardly and then upwardly around the bottom end of said panel where a flange channel is formed adjacent the upwardly facing primary drain channel to receive over flow water from water from said primary drain channel, said flange channel extends to said beam channel for emptying water therefrom.

16. The structure of claim 15 wherein said frame support structure is further defined by said beams being spaced apart and each of said panels having vertical perimeter frames being supported by said spaced apart beams engaging the glazing adjacent the oppositely disposed vertical perimeter frames whereby water in said primary and secondary drains may drain into each of said spaced apart beam channels.

17. The structure of claim 16 and a cover flashing is positioned over and secured to said horizontal perimeter frame, said cover flashing includes top and bottom sides and said flange channel abuts against the bottom side of said cover flashing to contain moisture in said primary and secondary drains.

18. The structure of claim 5 wherein said glazing panel includes top and bottom ends and said top end includes a horizontal perimeter frame having an upwardly facing channel on its topside and a downwardly facing channel on its bottom side, said top end being adjacent to and spaced from a vertical building wall, a cover flashing having a downwardly extending rib received in said upwardly facing channel, said cover flashing having a flange extending from said rib towards said building wall, a cover flashing receptor on said building wall and having an outwardly facing channel in which said flange is received, a downwardly and outwardly extending flange is provided with extends from said receptor and includes a lower end, a gutter flashing is positioned below said glazing top end and includes an upwardly extending rib received in said downwardly facing channel of said perimeter frame, a flange extends from said gutter rib upwardly towards said building wall and terminates upwardly and below the lower end of said cover flashing receptor flange whereby water in said gutter flashing is emptied into said beam channel.

19. The structure of claim 18 wherein said frame support structure is further defined by said beams being spaced apart and each of said panels having vertical perimeter frames being supported by said spaced apart beams engaging the glazing adjacent the oppositely disposed vertical perimeter frames whereby water in said gutter flashing may drain into each of said spaced apart beam channels.

* * * * *